US009540789B2

(12) United States Patent
Urbanowicz

(10) Patent No.: US 9,540,789 B2
(45) Date of Patent: Jan. 10, 2017

(54) SWING CONTROL SYSTEM FOR CONSTRUCTION MACHINES

(71) Applicant: VOLVO CONSTRUCTION EQUIPMENT AB, Eskilstuna (SE)

(72) Inventor: Marek Urbanowicz, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 0 days.

(21) Appl. No.: 14/765,787

(22) PCT Filed: Feb. 6, 2013

(86) PCT No.: PCT/KR2013/000951

§ 371 (c)(1),
(2) Date: Aug. 4, 2015

(87) PCT Pub. No.: WO2014/123253

PCT Pub. Date: Aug. 14, 2014

(65) Prior Publication Data

US 2015/0361641 A1 Dec. 17, 2015

(51) Int. Cl.
*E02F 9/20* (2006.01)
*E02F 9/12* (2006.01)
(Continued)

(52) U.S. Cl.
CPC ..... *E02F 9/123* (2013.01); *E02F 3/32* (2013.01); *E02F 9/2207* (2013.01);
(Continued)

(58) Field of Classification Search
None
See application file for complete search history.

(56) References Cited

U.S. PATENT DOCUMENTS

2004/0267404 A1* 12/2004 Danko ..... B25J 9/1607 700/245
2007/0271913 A1* 11/2007 Ikeda ..... E02F 3/43 60/421
(Continued)

FOREIGN PATENT DOCUMENTS

JP H09-151906 A 6/1997
JP 2009-036300 A 2/2009
(Continued)

OTHER PUBLICATIONS

International Search Report and Written Opinion of the International Searching Authority (in English) for PCT/KR2013/000951, mailed Oct. 16, 2013; ISA/KR.

*Primary Examiner* — Jonathan M Dager
(74) *Attorney, Agent, or Firm* — Harness, Dickey & Pierce, P.L.C.

(57) ABSTRACT

The disclosed invention relates to a swing control system for construction machines and is useful in a construction equipment in which the shaking or jerking movement of the upper swing structure due to the moment of inertia thereof is controlled by a simple electrical hydraulic control system so that although the swing manipulation is abruptly and repeatedly performed during the excavation or dumping operation, an operator can control the soft swing start/stop of the upper swing structure in the swing operation of construction machine, thereby improving manipulability and work efficiency of the work apparatus.

11 Claims, 3 Drawing Sheets

(51) Int. Cl.

| | |
|---|---|
| ***E02F 9/22*** | (2006.01) |
| ***E02F 3/32*** | (2006.01) |
| ***F15B 11/04*** | (2006.01) |
| ***F15B 11/042*** | (2006.01) |
| ***F15B 11/048*** | (2006.01) |

(52) U.S. Cl.
CPC ..... *E02F 9/2214* (2013.01); *F15B 11/042* (2013.01); *F15B 11/0406* (2013.01); *F15B 11/048* (2013.01)

(56) References Cited

U.S. PATENT DOCUMENTS

2008/0300757 A1* 12/2008 Kanayama ..... E02F 9/2025 701/50
2009/0139119 A1* 6/2009 Janardhan ..... B25J 9/1638 37/413
2009/0151346 A1* 6/2009 Kim ..... E02F 3/325 60/428
2010/0319338 A1* 12/2010 Ikeda ..... E02F 9/123 60/468
2011/0154815 A1* 6/2011 Lee ..... E02F 9/123 60/459
2012/0029663 A1* 2/2012 Danko ..... B25J 9/1628 700/29
2012/0131913 A1* 5/2012 Yoshino ..... E02F 9/2235 60/459
2012/0198831 A1* 8/2012 Kodaka ..... E02F 3/962 60/422
2013/0239560 A1* 9/2013 Kim ..... E02F 9/123 60/463
2013/0311054 A1* 11/2013 Choi ..... E02F 9/123 701/50
2014/0083092 A1* 3/2014 Son ..... E02F 9/226 60/456
2014/0137732 A1* 5/2014 Ku ..... E02F 9/2267 91/534
2014/0190153 A1* 7/2014 Britten ..... F16H 61/421 60/327
2014/0343805 A1* 11/2014 Suk ..... E02F 9/2285 701/50
2014/0345268 A1* 11/2014 Jeon ..... F15B 11/17 60/464
2014/0367529 A1* 12/2014 Choi ..... E02F 9/2275 248/68.1
2015/0176251 A1* 6/2015 Lee ..... E02F 9/2253 60/327
2015/0354174 A1* 12/2015 Lee ..... E02F 9/2253 701/50

FOREIGN PATENT DOCUMENTS

KR 10-0157275 B1 11/1998
KR 10-2001-0057430 A 7/2001
KR 10-2005-0119762 A 12/2005

* cited by examiner

SWING CONTROL SYSTEM FOR CONSTRUCTION MACHINES

TECHNICAL FIELD

The present invention relates to a swing control system for construction machines. More particularly, the present invention relates to a swing control system and construction machines operated by the swing control system, which is improved to smoothly control the movement of an upper swing structure of a construction machine by controlling swing start acceleration and swing stop deceleration.

BACKGROUND ART

In general, a construction machine including an excavator comprise work apparatus such as a boom, an arm, and a bucket, which is installed on an upper swing structure mounted on a lower traveling structure. The movement of the work apparatus and the upper swing structure is controlled so as to be operated in cooperation with each other so as to be to perform the excavation or dumping operation.

Referring to FIG. 1, generally, an excavator 100 is constructed such that a work apparatus including a bucket 2, an arm 3, and a boom 4 is pivotally mounted on an upper swing structure 1. In particular, the upper swing structure 1 is rotated in a clockwise or counterclockwise direction about a turning-joint (not shown) in response to an operator's swing operation.

The bucket 2 receives a load due to the weight of soil contained therein, and the upper swing structure 1 receives a large moment of inertia while being turned during the excavation or dumping operation.

The reason for this is that the bucket 2 is turned in a state of being away from the center of gravity of the upper swing structure 1 in a structural aspect. Further, as a load applied to the bucket 2 and a distance between the bucket 2 and the center of gravity of the upper swing structure 1 are larger, the moment of inertia is also larger.

In a state in which the bucket 2 is filled with soil, the moment of inertia generated upon a swing movement of the upper swing structure 1 is relatively large as compared to that in a state in which the bucket 2 is empty.

The moment of inertia may vary depending on the load applied to the bucket 2 as well as the inclined angle of the boom 4 with respect to a horizontal line. In addition, the larger the moment of inertia is, the larger vibration or the period of vibration is as well known in the art Thus, in the case where the swing operation of the upper swing structure 1 is repeatedly performed in the clockwise or counterclockwise direction, the upper swing structure 1 receives an abrupt shaking or jerking shock and an operator who controls the work apparatus within a cab 5 also feels a sudden shock and shaking at a time period when the swing movement is started or stopped.

Namely, when the construction machine moves to swing the upper swing structure during the swing start or stop operations, the swing motor and the control valves associated with the swing movement is opening and closing too fast and hydraulic fluid is starting and stopping so fast. It causes the occurrence of a big shaking or jerking movement due to the moment of inertia of bucket load and the upper swing structure.

Under such a situation, the excavation or dumping operation continues to be performed, manipulability of the work apparatus will be considerably deteriorated and work efficiency will also be adversely affected.

Various attempts have been made to solve the aforementioned disadvantages. For example, Korean Patent Laid-Open Publication No. 2001-0057430 discloses a swing control device for hydraulic construction equipment in which the moment of inertia corresponding to swing acceleration or swing deceleration of the work apparatus varies depending on a change in the angle of a boom so as to solve a problem associated with an increase of a shock applied to the equipment when the swing operation is started or stopped.

In the above patent, there is disclosed a technology in which as the angle of the boom is changed, a controller generates a current signal corresponding to a change in the angle of the boom for application to a proportional pressure control valve so as to make the pilot pressure for the swing control variable and make variable the operation of a direction control valve adjusting the flow path to supply a fluid to a swing motor according to a variation of the pilot pressure, so that a degree of acceleration or deceleration is controlled upon the start or stop of the swing operation to reduce the occurrence of the abrupt movement upon the quick stop or quick swing.

However, such a conventional technology entails a disadvantage in that since the movement of inertia of the upper swing structure varying depending on the angle of the boom and the variable control of the direction control valve for the swing operation must be taken into consideration, a hydraulic circuit is complicated in which a boom angle sensor and a pressure reducing valve are combined.

DISCLOSURE OF INVENTION

Technical Problem

Accordingly, the present invention was made to solve the aforementioned problem occurring in the prior art, and it is an object of the present invention to provide a swing control system for construction machines, in which the swing movement is smoothly controlled with a soft swing start and a soft swing stop so that although the swing manipulation is abruptly performed during the excavation or dumping operation, manipulability and work efficiency of the work apparatus can maintained in a favorable state.

Another object of the present invention is to provide a swing control system for construction machines, in which a swing movement of the upper swing structure is controlled, depending on a potential difference between the pressure detecting means and a predetermined transform algorithm so that the shaking and shock of the upper swing structure caused by the shaking or jerking movement of inertia thereof can be effectively reduced and the swing movement of a swing start acceleration and a swing stop deceleration can be smoothly controlled.

Solution to Problem

In accordance with one aspect of the present invention, there is provided a swing control system for construction machines, including:

a hydraulic pump;

a swing motor driven by a hydraulic fluid supplied from the hydraulic pump and configured to swing an upper swing structure;

a swing control valve installed between the hydraulic pump and the swing motor, and configured to control the flow rate of the hydraulic fluid supplied and returned to the swing motor via a pair of hydraulic lines;

swing manipulation means configured to apply a spool shift signal corresponding to a manipulated variable of an operator to the swing control valve;

a shuttle valve installed on a relief line branched off from the hydraulic lines, and configured to select a higher pressure of the pressures of the hydraulic lines and drain a hydraulic fluid of the selected hydraulic line having the higher pressure to the relief line;

a relief valve installed on the relief line at the downstream side of the shuttle valve, and configured to control a required flow rate for a soft swing start to drain the hydraulic fluid through a first cutoff valve to a hydraulic tank, when the first cutoff valve is opened during swing start acceleration;

a first cutoff valve installed between the shuttle valve and the relief valve, and configured to selectively control the required flow rate for the soft swing start through the shuttle valve during swing start acceleration;

a second cutoff valve installed on a connection line branched off from the pair of hydraulic lines, and configured to selectively control a required flow rate for a soft swing stop on the connection line during swing stop deceleration;

a pair of pressure detecting means configured to sense the signal pressure provided to the swing control valve to shift or switch a spool; and an electric controller electrically connected to the relief valve, the first cutoff valve, the second cutoff valve, and the pressure sensors, the electric controller being configured to determine whether the upper swing structure is in the soft swing start or stop, based on a potential pressure difference between the pressure detecting means, an inertial transform function and a derivative function operated by a predetermined algorithm, and selectively output valve control signals for controlling the valves during the swing start acceleration and the swing stop deceleration.

According to the swing control system for construction machines of the present invention, the inertial transform function of the electric controller 6 provides a smoother signal from almost square wave signal of the pressure detecting means, which is expressed by an equation, $$Ut = \frac{K}{ts-1},$$

wherein T is the machine/bucket size, and K is the pressure/valves voltages.

In addition, according to the swing control system for construction machines of the present invention, the derivative function is applied to recognize the soft swing start or the soft swing stop, which is expressed by an equation $U_1(t)=Udt$.

According to the swing control system for construction machines of the present invention, the electric controller outputs the valve control signal discontinuously at a certain interval time in the swing start operation or swing stop operation.

According to the swing control system for construction machines of the present invention, the pressure detecting means includes a pressure sensor.

According to one embodiment of the present invention, the swing control system for construction machines further includes a variable throttle valve installed on the connection line.

According to the swing control system for construction machines of the present invention, the swing manipulation means includes a hydraulic joystick.

According to one embodiment of the present invention, the swing manipulation means includes an electric joystick.

In accordance with another aspect of the present invention, there is provided a construction machines having a lower traveling structure, an upper swing structure and a work apparatus attached to the upper swing structure, the upper swing structure mounted on the lower traveling structure to be swiveled, the work apparatus including a bucket, an arm and a boom pivotally connected on the upper swing structure, comprising:

a hydraulic pump;

a swing motor driven by a hydraulic fluid supplied from the hydraulic pump and configured to swing an upper swing structure;

a swing control valve installed between the hydraulic pump and the swing motor, and configured to control the flow rate of the hydraulic fluid supplied and returned to the swing motor via a pair of hydraulic lines;

swing manipulation means configured to apply a spool shift signal corresponding to a manipulated variable of an operator to the swing control valve;

a shuttle valve installed on a relief line branched off from the hydraulic lines, and configured to select a higher pressure of the pressures of the hydraulic lines and drain a hydraulic fluid of the selected hydraulic line having the higher pressure to the relief line;

a relief valve installed on the relief line at the downstream side of the shuttle valve, and configured to control a required flow rate for a soft swing start to drain the hydraulic fluid through a first cutoff valve to a hydraulic tank, when the first cutoff valve is opened during swing start acceleration;

a first cutoff valve installed between the shuttle valve and the relief valve, and configured to selectively control the required flow rate for the soft swing start through the shuttle valve during swing start acceleration;

a second cutoff valve installed on a connection line branched off from the pair of hydraulic lines, and configured to selectively control a required flow rate for a soft swing stop on the connection line during swing stop deceleration;

a pair of pressure detecting means configured to sense the signal pressure provided to the swing control valve to shift or switch a spool; and an electric controller electrically connected to the relief valve, the first cutoff valve, the second cutoff valve, and the pressure sensors, the electric controller being configured to determine whether the upper swing structure is in the soft swing start or stop, based on a potential pressure difference between the pressure detecting means, an inertial transform function and a derivative function operated by a predetermined algorithm, and selectively output valve control signals for controlling the valves during the swing start acceleration and the swing stop deceleration.

According to the construction machines of the present invention, the inertial transform function of the electric controller 6 provides a smoother signal from almost square wave signal of the pressure detecting means, which is expressed by an equation, $$Ut = \frac{K}{ts-1},$$

wherein T is the machine/bucket size, and K is the pressure/valves voltages; and the derivative function is applied to recognize the soft swing start or the soft swing stop, which is expressed by an equation $U_1(t)=Udt$.

Advantageous Effects of Invention

The swing control system for construction machines according to the present invention has advantages in that valve elements such as a first cutoff valve and a relief valve, and a second cutoff valve and a variable throttle valve are properly controlled in a swing start acceleration and a swing stop deceleration depending on potential pressure difference between the pressure detecting means and a predetermined transform algorithm so that the swing movement of the upper swing structure is smoothly performed and the shaking and shock of the upper swing structure are effectively reduced and damped in swing operation.

The swing control system for construction machines according to the present invention also has advantages in that the shaking movement of the upper swing structure due to the moment of inertia thereof is controlled by a simple electrical hydraulic control system so that although the swing manipulation of the upper swing structure is abruptly or repeatedly performed during the excavation or dumping operation, an operator can control the swing operation of the upper swing structure smoothly, thereby improving manipulability and work efficiency of the work apparatus.

BRIEF DESCRIPTION OF DRAWINGS

The above objects, other features and advantages of the present invention will become more apparent by describing the preferred embodiments thereof with reference to the accompanying drawings, in which.

MODE FOR THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

A swing control system for construction machines according to the present invention controls valves elements in a soft swing start operation and a soft swing stop operation in a simple electric control manner to perform a smooth swing operation of an upper swing structure, which will be described hereinafter in more detail with reference to the accompanying drawings.

Figure 1:
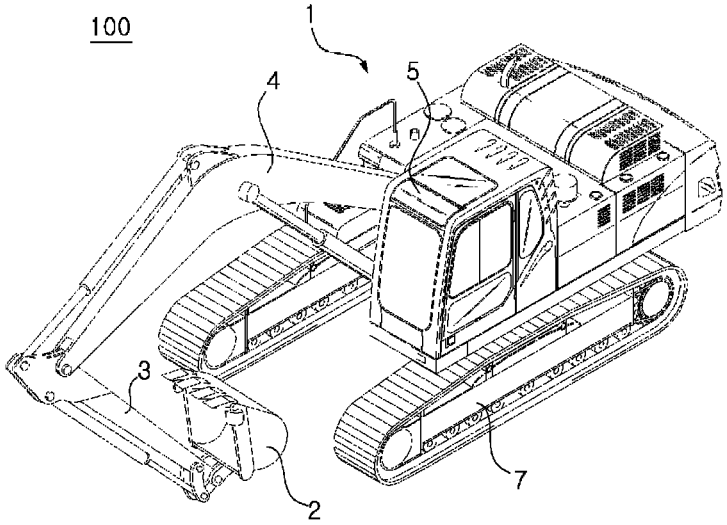
FIG. 1 is a schematic perspective view showing a conventional excavator according to the prior art.
Figure 2:
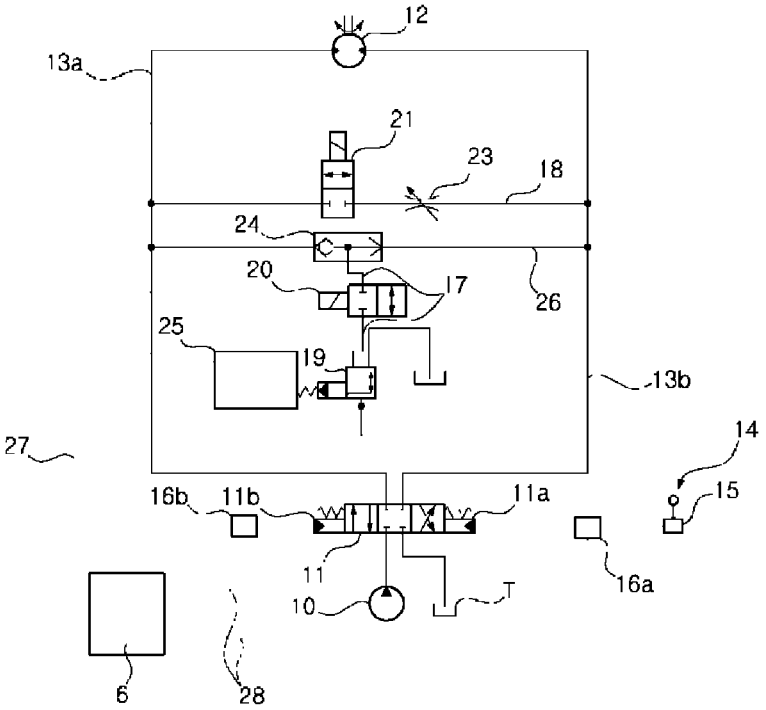
Prior Art FIG. 2
FIG. 2 is a hydraulic circuit diagram of a swing control system for construction machines according to one embodiment of the present invention.

As shown in the schematic hydraulic circuit diagram of FIG. 2, a hydraulic fluid drained from a hydraulic pump 10 is supplied to a swing motor 12 to perform a swing operation of an upper swing structure 1.

A swing control valve 11 is installed between the hydraulic pump 10 and the swing motor 12. The swing control valve 11 is connected to the swing motor 12 via a pair of hydraulic lines 13*a* and 13*b*. The hydraulic lines 13*a* and 13*b* acts as a supply line or a return line of the hydraulic fluid to perform the swing operation.

The swing control valve 11 controls the direction and flow rate of the hydraulic fluid supplied and returned to the swing motor 12 via the pair of hydraulic lines 13*a* and 13*b*, and includes signal pressure receiving portions 11*a* and 11*b* of a spool. For the purpose of the direction switching of the swing control valve 11, the swing control system for construction machines includes swing manipulation means 14 for applying a spool shift signal corresponding to a manipulated variable of an operator to the spool shift signal receiving portion 11*a* and 11*b* formed at the both sides of the spool.

According to the directional control of the swing control valve 11, the swing motor 12 can be actuated in rotation and the upper swing structure 1 mounted on the lower traveling structure 7 to be swiveled, the work apparatus including a bucket 2, an arm 3 and a boom 4 pivotally connected on the upper swing structure 1 also are operated with the swing movement of the upper swing structure 1.

Preferably, the swing manipulation means 14 is comprised as a hydraulic joystick including a remote control valve 15 that supplies a pilot signal pressure to the signal pressure receiving portions 11*a* and 11*b* of the swing control valve 11 using the hydraulic fluid provided from an auxiliary pump (not shown) as a spool shift signal.

In another modified embodiment, the swing manipulation means 14 may be comprised as an electric joystick.

The swing control system for construction machines according to the present invention includes a pair of pressure detecting means 16*a* and 16*b* that senses the signal pressure supplied to the spool shift signal receiving portion 11*a* and 11*b* of the swing control valve 11 to shift or switch the spool, and a shuttle valve 24 installed on a relief line 17 branched off from the hydraulic lines 13*a*, and 13*b*.

Preferably, the pressure detecting means 16*a* and 16*b* includes a pressure sensor that detects the pilot signal pressure supplied to the spool shift signal receiving portion 11*a* and 11*b* when the swing manipulation means 14 is manipulated. The pilot signal pressure detected by each the pressure sensors 16*a* and 16*b* is provided to the electric controller 6 through a control line 28.

The shuttle valve 24 selects a higher pressure of the pressures of the hydraulic lines 16*a* and 16*b* and drain a hydraulic fluid of the selected hydraulic line 16*a* or 16*b* having the higher pressure to the relief line 17. If the rotation direction of the swing motor 12 is switched, a hydraulic line 13*a* or 13*b* having the higher pressure selected through the shuttle valve 24 may also be changed.

A relief valve 19 according to the present invention is installed on the relief line 17 at the downstream side of the shuttle valve 24. The relief valve 19 is installed on the relief line 17 at the downstream side of the shuttle valve 24, and configured to control a required flow rate for a soft swing start to drain the hydraulic fluid through a first cutoff valve 20 to a hydraulic tank T, when the first cutoff valve 20 is opened during swing start acceleration.

According to the present invention, the first cutoff valve 20 is installed between the shuttle valve 24 and the relief valve 19, and selectively controls the required flow rate of for the soft swing start through the shuttle valve 24. More particularly, the first cutoff valve 20 is configured to control the hydraulic pressure of the hydraulic line 13*a* or 13*b* selected by the shuttle valve 24 during swing start acceleration.

For example, when the swing control valve 11 is switched to the left on the drawing, the hydraulic fluid is supplied to the swing motor 12 via the right hydraulic line 13*a* and then the hydraulic fluid passed through the swing motor 12 is returned to the hydraulic tank via the left hydraulic line 13*b*, as shown in FIG. 2.

In this case, when the hydraulic fluids of the left hydraulic line 13*a* and the right hydraulic line 13*b* are introduced into the shuttle valve 24 via a branched line 26, the shuttle valve 24 selects a required hydraulic fluid having a higher hydraulic pressure level of the introduced hydraulic fluids and drains the selected hydraulic fluid to an outlet port, when the first cutoff valve 20 is switched to an opened position during swing start acceleration.

According to an embodiment of the present invention, in consideration of the system pressure after the soft swing start, if the pressure of the hydraulic fluid drained through the outlet port of the shuttle valve 24 exceeds a predetermined relief pressure, the hydraulic fluid can be drained to the hydraulic tank T through the relief valve 19.

The swing control system for construction machines according to the present invention includes a second cutoff valve 21 installed on a connection line 18 branched off from the pair of hydraulic lines 13*a* and 13*b*, and configured to selectively control a required flow rate for a soft swing stop on the connection line 18 with a variable throttle valve 23 during swing stop deceleration.

Further, the swing control system for construction machines according to the present invention includes an electric controller 6 that electrically connected to the relief valve 19, the first cutoff valve 20, the second cutoff valve 21, and the pressure sensors 16*a* and 16*b* through the control lines 27 and 28.

The electric controller 6 configured to determine whether the upper swing structure is in the soft swing start or stop, based on a potential pressure difference between the pressure sensors 16*a* and 16*b*, an inertial transform function and a derivative function operated by a predetermined algorithm, and selectively output valve control signals for controlling the valves 19, 20 and 21 during the swing start acceleration and the swing stop deceleration.

Particularly, the inertial transform function of the electric controller 6 provides a smoother signal from almost square wave signal, which is expressed by an equation, $$Ut = \frac{K}{ts-1},$$

wherein T is the machine/bucket size, and K is the pressure/valves voltages.

According to the inertial transform function of the electric controller 6, the pressure sensors deferential is provided to generate a square wave signal and, particularly, even square wave signal from the pressure sensors is made smoother by the inertial transform function.

Then, in order to determine a soft swing start operation or a soft swing stop operation, the derivative function is applied to the electric controller 6, which is expressed by an equation $U_1(t)=Udt$.

After the transform, the swing start operation or the swing stop operation is recognized, based on sign of U1t and the electric controller 6 outputs valve control signals corresponding to the required flow rates for controlling valves 19, 20 and 21.

According to the present invention, the required flow rates are independently adjusted by the electric controller 6, depending on soft swing start/stop operations. Further, a required margin for being disable the soft swing start or stop operations is set on the electric controller 6.

Figure 3:
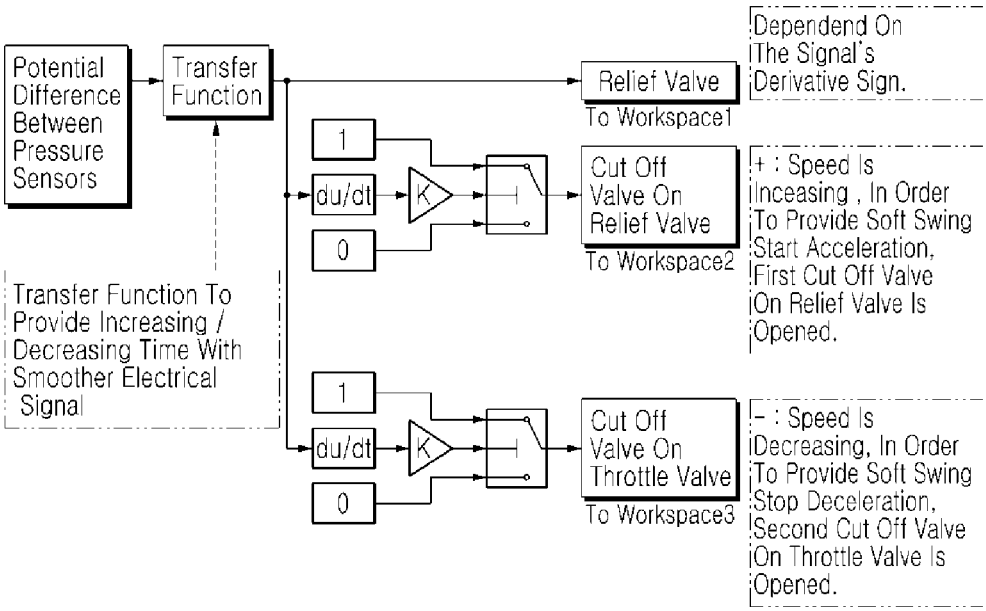
FIG. 3 is a schematic block diagram of an electrical valve control signal processing of a swing control system for construction machines according to one embodiment of the present invention.

Referring to the FIG. 3, during valve signal control of the electric controller 6, the transfer functions can provide an increasing time or a decreasing time with smoother electrical signal and the electric controller 6 generates valve control signals for the relief valve 19, the first cutoff valve 20 and the second cutoff valve 21 through the control lines 27.

The valve control signal outputted from the electric controller 6 includes an electric solenoid control signal or an electro-hydraulic signal for adjusting a valve opening or closing to be the soft swing start/stop during operator's swing manipulation. The electric solenoid control signal and the electro-hydraulic signal can be outputted independently through a control line 27. Further, the electric controller 6 may output the valve control signal continuously or discontinuously at a certain interval time in the swing start operation or swing stop operation. It will be understood that the valve control signal is changed continuously or discontinuously until it is determined that the swing start or stop operation is terminated.

According to the valve control signal, the flow rate of the valves 19, 20 and 21 electrically is controlled. During the swing start operation or the swing stop operation, a solenoid portion or a magnet portion of the valve 20 and 21 is switched by Boolean type—TRUE/OPENED or FALSE/CLOSED.

Particularly, during the swing start operation, the first cut off valve 20 on the relief line 17 is operated by ON/OFF manner and the flow rate of the first cut off valve 20 is depend on pressure on the swing motor 12, which is providing the swing control system faster start with smaller load of the bucket 2 and longer with bigger load of the bucket 2.

Meanwhile, according to an embodiment of the present invention, the swing control system further comprises a potentiometer for detecting the inertia of the upper swing structure 1 and the relief valve 19 is dependent on the signal's derivative sign of the electric controller 6 and may be controlled through a valve adjuster 25 as shown in FIG. 2.

Further, it will be understood that if the pressure of the hydraulic fluid drained through the outlet port of the shuttle valve 24 exceeds a predetermined relief pressure, the hydraulic fluid can be drained to the hydraulic tank T through the relief valve 19 after the soft swing start or stop operations.

Conventionally, the construction machine has a big shaking or jerking movement, when the construction machine moves to swing the upper swing structure in the swing start or stop operations, However, according to the present invention, the occurrence of a shaking or jerking movement can be reduced or suppressed, the swing start or stop is operated in a soft or smoother swing movement.

For example, referring to in FIGS. 2 and 3, during swing operation for the excavation or dumping operation, the pilot signal is applied to the signal pressure receiving portions 11*a* and 11*b* of the spool in response to the swing manipulation means 14 of pushing or pulling the joystick 14.

The swing control valve 11 is switched to the left on the drawing by the pilot signal pressure applied to the signal pressure receiving portions 11*a* positioned at the right side on the drawing, and the hydraulic fluid from the hydraulic pump 10 is supplied to the swing motor 12 via the supply line 13*a* to actuate the swing motor 12. Thereafter, the hydraulic fluid is returned to the hydraulic tank T via the return line 13*b*.

According to the present invention, the pilot signal pressure for shifting a spool of the swing control valve 11 is sensed by the pressure sensors 16*a* and 16*b* and each the signal pressures are applied to the electric controller 6.

The electric controller 6 determines whether the upper swing structure is in swing start operation based on the potential difference (ΔP) between the pressure sensors 16*a* and 16*b* and the inertial transform function and a derivative function of the predetermined algorithm.

If determined or recognized in swing start operation or start acceleration, speed of the swing movement is increasing. At this time, the first cutoff valve 20 on the relief line 17 and the relief valve 19 are controlled to open by the valve control signal through the control line 27 from the electric controller 6.

Figure 4A:
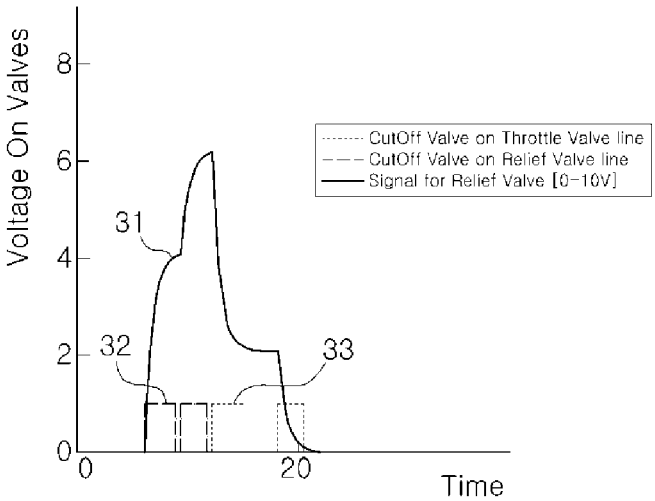
FIG. 4 is a graph showing a valve characteristics during a soft swing start and stop operation.
Figure 4B:
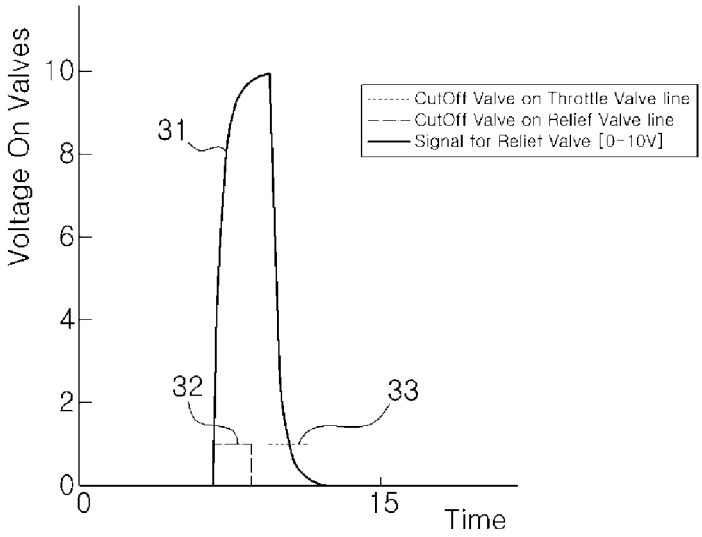

As mentioned above, during the in swing start operation, square wave signal from the pressure sensors 16*a* and 16*b* is made smoother by the inertial transform function of the electric controller 6, thereby the valve opening or the flow rate of the first cutoff valve 20 and the relief valve 19 to be controlled in slower speed, as shown in FIG. 4.

Therefore, although operator abruptly manipulates the joystick 14 in swing start operation, the upper swing structure 1 of the construction machine moves to be smoother or soft and the occurrence of a shaking or jerking movement can be reduced.

Meanwhile, the electric controller 6 determines whether the upper swing structure is in swing stop operation based on the potential difference (ΔP) between the pressure sensors 16*a* and 16*b* and the inertial transform function and a derivative function of the predetermined algorithm.

If determined or recognized in swing stop operation or stop deceleration, speed of the swing movement is decreasing. At this time, the second cutoff valve 21 on the branched line 18 and the variable throttle valve 23 are controlled to open by the valve control signal through the control line 27 from the electric controller 6.

During the in swing stop operation, square wave signal from the pressure sensors 16*a* and 16*b* is made smoother by the inertial transform function of the electric controller 6, thereby the valve opening or the flow rate of the second cutoff valve 21 and variable throttle valve 23 to be controlled in slower speed, as shown in FIG. 4. The valve opening degree or the opened position of the second cutoff valve 21 may be changed continuously or discontinuously until it is determined that the swing stop operation is terminated. At this time, the flow rate of the drained hydraulic fluid passing through the second cutoff valve 21 and the variable throttle valve 23 is properly adjusted during the soft swing stop operation. The flow rate of the variable throttle valve 23 is different from the second cutoff valve 21, dependent on a required damping performance.

Therefore, although operator abruptly manipulates the joystick 14 in swing stop operation, the upper swing structure 1 of the construction machine moves to be smoother or soft and the occurrence of a shaking or jerking movement can be reduced.

INDUSTRIAL APPLICABILITY

The swing control system for construction machines according to the present invention is useful in a construction equipment in which the shaking or jerking movement of the upper swing structure due to the moment of inertia thereof is controlled by a simple electrical hydraulic control system so that although the swing manipulation is abruptly and repeatedly performed during the excavation or dumping operation, an operator can control the swing operation smoothly, thereby improving manipulability and work efficiency of the work apparatus.

The invention claimed is:

1. A swing control system for construction machines, comprising: a hydraulic pump;

a swing motor driven by a hydraulic fluid supplied from the hydraulic pump and configured to swing an upper swing structure;

a swing control valve installed between the hydraulic pump and the swing motor, and configured to control the flow rate of the hydraulic fluid supplied and returned to the swing motor via a pair of hydraulic lines;

swing manipulation means configured to apply a spool shift signal corresponding to a manipulated variable of an operator to the swing control valve;

a shuttle valve installed on a relief line branched off from the hydraulic lines, and configured to select a higher pressure of the pressures of the hydraulic lines and drain a hydraulic fluid of the selected hydraulic line having the higher pressure to the relief line;

a relief valve installed on the relief line at the downstream side of the shuttle valve, and configured to control a required flow rate for a soft swing start to drain the hydraulic fluid through a first cutoff valve to a hydraulic tank, when the first cutoff valve is opened during swing start acceleration;

a first cutoff valve installed between the shuttle valve and the relief valve, and configured to selectively control the required flow rate for the soft swing start through the shuttle valve during swing start acceleration;

a second cutoff valve installed on a connection line branched off from the pair of hydraulic lines, and configured to selectively control a required flow rate for a soft swing stop on the connection line during swing stop deceleration;

a pair of pressure detecting means configured to sense the signal pressure provided to the swing control valve to shift or switch a spool; and an electric controller electrically connected to the relief valve, the first cutoff valve, the second cutoff valve, and the pressure sensors, the electric controller being configured to determine whether the upper swing structure is in the soft swing start or stop, based on a potential pressure difference between the pressure detecting means, an inertial transform function and a derivative function operated by a predetermined algorithm, and selectively output valve control signals for controlling the valves during the swing start acceleration and the swing stop deceleration.

2. The swing control system for construction machines according to claim 1, wherein the inertial transform function of the electric controller provides a smoother signal from almost square wave signal of the pressure detecting means, which is expressed by an equation, $$Ut = \frac{K}{Ts - 1},$$

wherein T is the machine/bucket size, and K is the pressure/valves voltages.

3. The swing control system for construction machines according to claim 1, wherein the derivative function is applied to recognize the soft swing start or the soft swing stop, which is expressed by an equation $U_1(t)=Udt$.

4. The swing control system for construction machines according to claim 1, wherein the electric controller outputs the valve control signal continuously until it is determined that the swing start operation or stop operation is terminated.

5. The swing control system for construction machines according to claim 2, wherein the electric controller outputs the valve control signal discontinuously at a certain interval time in the swing start operation or swing stop operation.

6. The swing control system for construction machines according to claim 1, wherein the pressure detecting means includes a pressure sensor.

7. The swing control system for construction machines according to claim 1, further comprising a variable throttle valve installed on the connection line.

8. The swing control system for construction machines according to claim 7, wherein the swing manipulation means includes a hydraulic joystick.

9. The swing control system for construction machines according to claim 8, wherein the swing manipulation means includes an electric joystick.

10. A construction machine having a lower traveling structure, an upper swing structure and a work apparatus attached to the upper swing structure, the upper swing structure mounted on the lower traveling structure to be swiveled, the work apparatus including a bucket, an arm and a boom pivotally connected on the upper swing structure, comprising:

a hydraulic pump;

a swing motor driven by a hydraulic fluid supplied from the hydraulic pump and configured to swing an upper swing structure;

a swing control valve installed between the hydraulic pump and the swing motor, and configured to control the flow rate of the hydraulic fluid supplied and returned to the swing motor via a pair of hydraulic lines;

swing manipulation means configured to apply a spool shift signal corresponding to a manipulated variable of an operator to the swing control valve;

a shuttle valve installed on a relief line branched off from the hydraulic lines, and configured to select a higher pressure of the pressures of the hydraulic lines and drain a hydraulic fluid of the selected hydraulic line having the higher pressure to the relief line;

a relief valve installed on the relief line at the downstream side of the shuttle valve, and configured to control a required flow rate for a soft swing start to drain the hydraulic fluid through a first cutoff valve to a hydraulic tank, when the first cutoff valve is opened during swing start acceleration;

a first cutoff valve installed between the shuttle valve and the relief valve, and configured to selectively control the required flow rate for the soft swing start through the shuttle valve during swing start acceleration;

a second cutoff valve installed on a connection line branched off from the pair of hydraulic lines, and configured to selectively control a required flow rate for a soft swing stop on the connection line during swing stop deceleration;

a pair of pressure detecting means configured to sense the signal pressure provided to the swing control valve to shift or switch a spool; and an electric controller electrically connected to the relief valve, the first cutoff valve, the second cutoff valve, and the pressure sensors, the electric controller being configured to determine whether the upper swing structure is in the soft swing start or stop, based on a potential pressure difference between the pressure detecting means, an inertial transform function and a derivative function operated by a predetermined algorithm, and selectively output valve control signals for controlling the valves during the swing start acceleration and the swing stop deceleration.

11. The construction machines according to claim 10, wherein the inertial transform function of the electric controller provides a smoother signal from almost square wave signal of the pressure detecting means, which is expressed by an equation, $$Ut = \frac{K}{Ts-1},$$

wherein T is the machine/bucket size, and K is the pressure/valves voltages; and the derivative function is applied to recognize the soft swing start or the soft swing stop, which is expressed by an equation U1(t)=Udt.

* * * * *